US007975705B2

(12) United States Patent
Chen

(10) Patent No.: US 7,975,705 B2
(45) Date of Patent: Jul. 12, 2011

(54) COSMETIC CONTAINER

(76) Inventor: Sin-Hsiung Chen, Yung-Kang (TW)

( * ) Notice: Subject to any disclaimer, the term of this patent is extended or adjusted under 35 U.S.C. 154(b) by 505 days.

(21) Appl. No.: 12/124,054

(22) Filed: May 20, 2008

(65) Prior Publication Data

US 2009/0288677 A1 Nov. 26, 2009

(51) Int. Cl.

| | |
|---|---|
| ***A45D 33/20*** | (2006.01) |
| ***A45D 42/02*** | (2006.01) |
| ***A45D 40/24*** | (2006.01) |
| ***A45D 42/00*** | (2006.01) |
| ***B65D 69/00*** | (2006.01) |
| ***B65D 71/00*** | (2006.01) |
| ***B65D 43/12*** | (2006.01) |
| ***B65D 43/20*** | (2006.01) |

(52) U.S. Cl. ..... 132/287; 132/301; 132/314; 132/316; 206/581; 220/345.4

(58) Field of Classification Search ..... 132/287, 132/291, 292, 294, 301, 314, 315, 316, 317, 132/318, 302, 303, 304, 305, 306; 206/6.1, 206/1.5, 555, 823, 581, 38, 235, 39.4, 751, 206/742, 754; 220/4.22, 4.27, 345.2, 345.3, 220/345.1, 348, 351, 500, 520, 523, 524, 220/528, 532, 533, 345.4; D28/91; D9/420, D9/422

See application file for complete search history.

(56) References Cited

U.S. PATENT DOCUMENTS

| | | | | |
|---|---|---|---|---|
| 1,895,061 | A * | 1/1933 | Stephenson | 132/287 |
| 1,908,132 | A * | 5/1933 | Duell et al. | 132/304 |
| D268,292 | S * | 3/1983 | Chevassus | D28/83 |
| 4,744,376 | A * | 5/1988 | Verducci | 132/297 |
| 4,932,547 | A * | 6/1990 | Rodriguez | 220/8 |
| 5,163,457 | A * | 11/1992 | Lombardi, Jr. | 132/304 |
| 5,483,981 | A * | 1/1996 | Vandromme et al. | 132/315 |
| 6,311,701 | B1 * | 11/2001 | Yuhara et al. | 132/294 |
| 6,386,209 | B1 * | 5/2002 | Yuhara et al. | 132/294 |
| 6,889,696 | B2 * | 5/2005 | Thorpe et al. | 132/287 |
| 7,140,372 | B2 * | 11/2006 | Byun | 132/287 |
| 7,469,787 | B2 * | 12/2008 | Yuhara | 206/581 |
| 7,591,382 | B2 * | 9/2009 | Brock | 211/10 |
| 7,828,000 | B2 * | 11/2010 | Lee | 132/287 |
| 2004/0206370 | A1 * | 10/2004 | Byun | 132/287 |
| 2006/0219256 | A1 * | 10/2006 | Byun | 132/287 |
| 2007/0261710 | A1 * | 11/2007 | Son et al. | 132/293 |
| 2009/0071867 | A1 * | 3/2009 | Au | 206/581 |
| 2010/0224212 | A1 * | 9/2010 | Chen | 132/287 |

* cited by examiner

*Primary Examiner* — Todd E Manahan
*Assistant Examiner* — Vanitha Elgart
(74) *Attorney, Agent, or Firm* — patenttm.us

(57) ABSTRACT

A cosmetic container in accordance with the present invention has a base, a slide cover, a drawer and a transmission device. The base has a chamber, an opening and a mirror. The chamber is defined in the base. The opening is formed in the base and communicates with the chamber. The mirror is mounted on an upper part of the front. The slide cover is slidably mounted on the front of the base. The drawer is slidably mounted in the chamber of the base and selectively extends out of the chamber through the opening of the base. The transmission device is mounted inside the chamber, connects to the slide cover and the drawer and selectively ejects the drawer out of the base when driven by the slide cover. With the transmission, operating the cosmetic container is simple and convenient.

19 Claims, 7 Drawing Sheets

COSMETIC CONTAINER

BACKGROUND OF THE INVENTION

1. Field of the Invention

The present invention relates to a container, and more particularly to a cosmetic container that is easy to operate and carry and orderly holds different cosmetic products.

2. Description of the Related Art

Women who use cosmetics to have good looks usually carry cosmetic products with them to keep the effect of the cosmetics on face. They often use portable cosmetic bags to help collect their cosmetic products.

However the cosmetic products in a cosmetic bag may include powder, eye shadow, blush, mascara tube, concealer, eyebrow pencil, lipstick or eye-shadow pencil and corresponding cosmetic tools. When a user wants to apply cosmetics, he/she may take a while to look for the needed cosmetic due to those disorderly arranged cosmetic products in the cosmetic bag. Thus, it is inconvenient to apply make-up promptly.

Furthermore, cosmetic products do not have any mechanism simplifying and facilitating the operation of the cosmetic products.

To overcome the shortcomings, the present invention provides a cosmetic container to mitigate or obviate the aforementioned problems.

SUMMARY OF THE INVENTION

The main objective of the invention is to provide a cosmetic container that is easy to operate and carry and orderly holds different cosmetic products.

A cosmetic container in accordance with the present invention comprises a base, a slide cover, a drawer and a transmission device. The base has a chamber, an opening and a mirror. The chamber is defined in the base. The opening is formed in the base and communicates with the chamber. The mirror is mounted on an upper part of the front. The slide cover is slidably mounted on the front of the base. The drawer is slidably mounted in the chamber of the base and selectively extends out of the chamber through the opening of the base. The transmission device is mounted inside the chamber, connects to the slide cover and the drawer and selectively ejects the drawer out of the base when driven by the slide cover.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
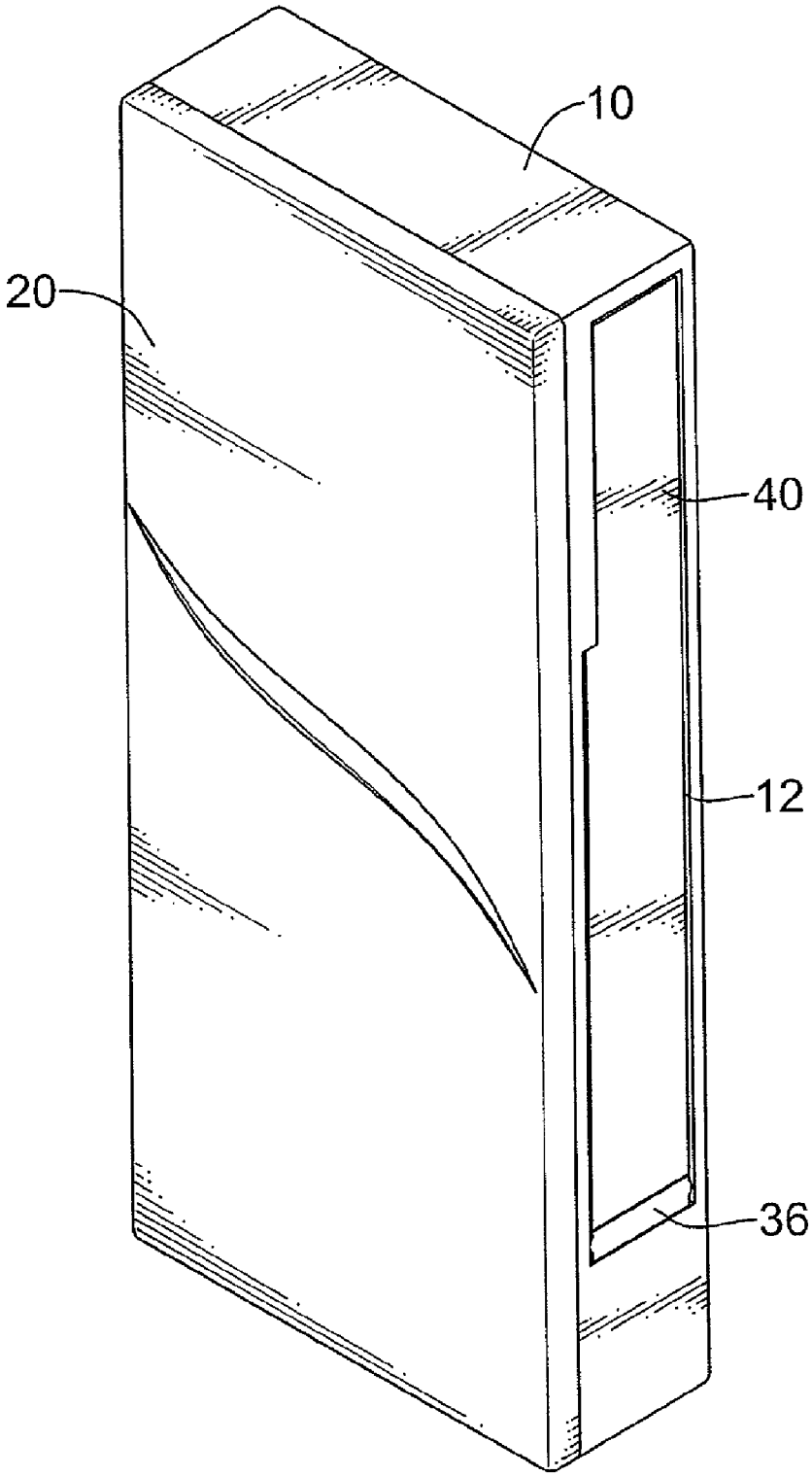
FIG. 1 is a perspective view of a first embodiment of a cosmetic container in accordance with the present invention.
Figure 2:
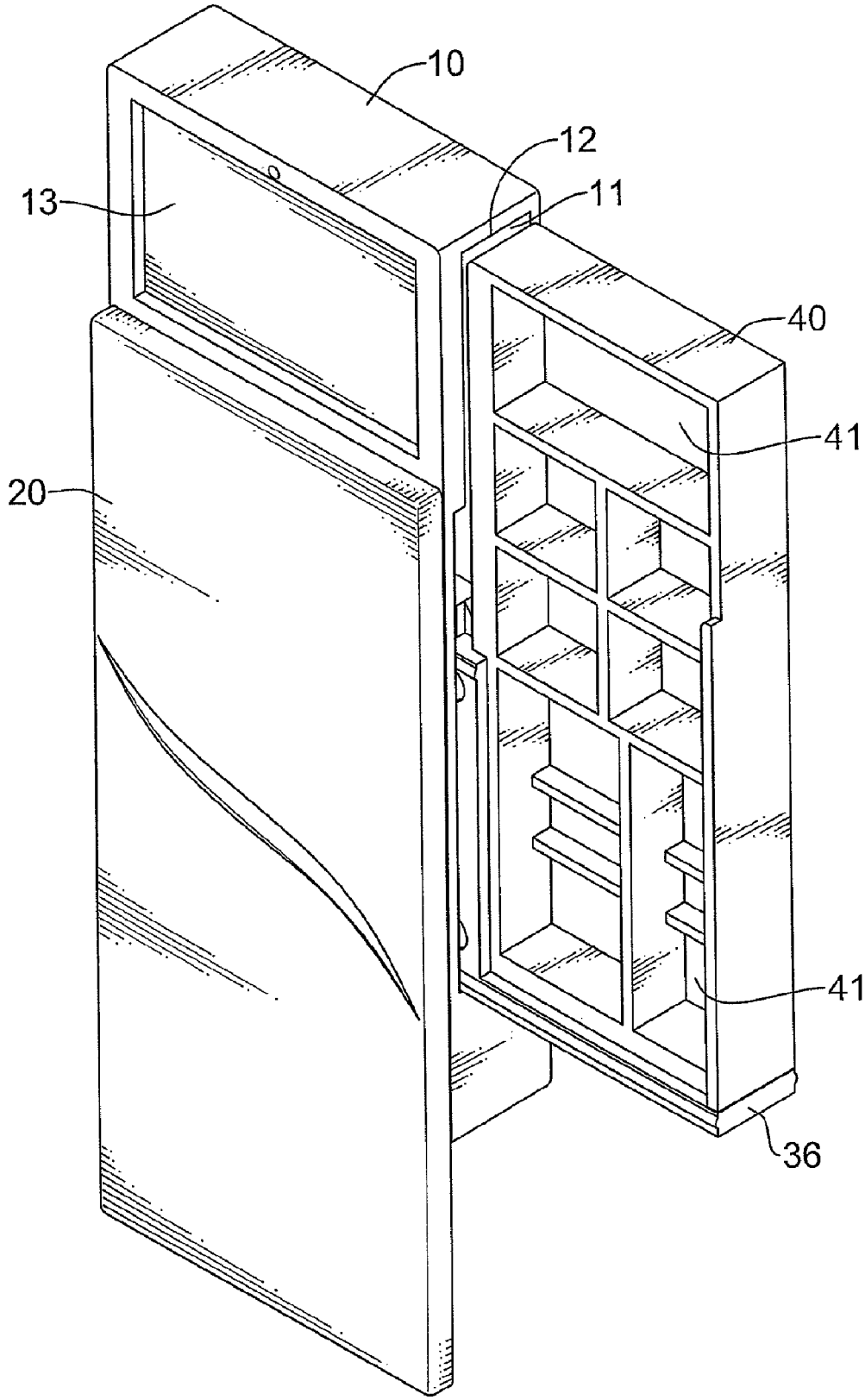
FIG. 2 is an operational perspective view of the cosmetic container in FIG. 1 in an open status.
Figure 3:
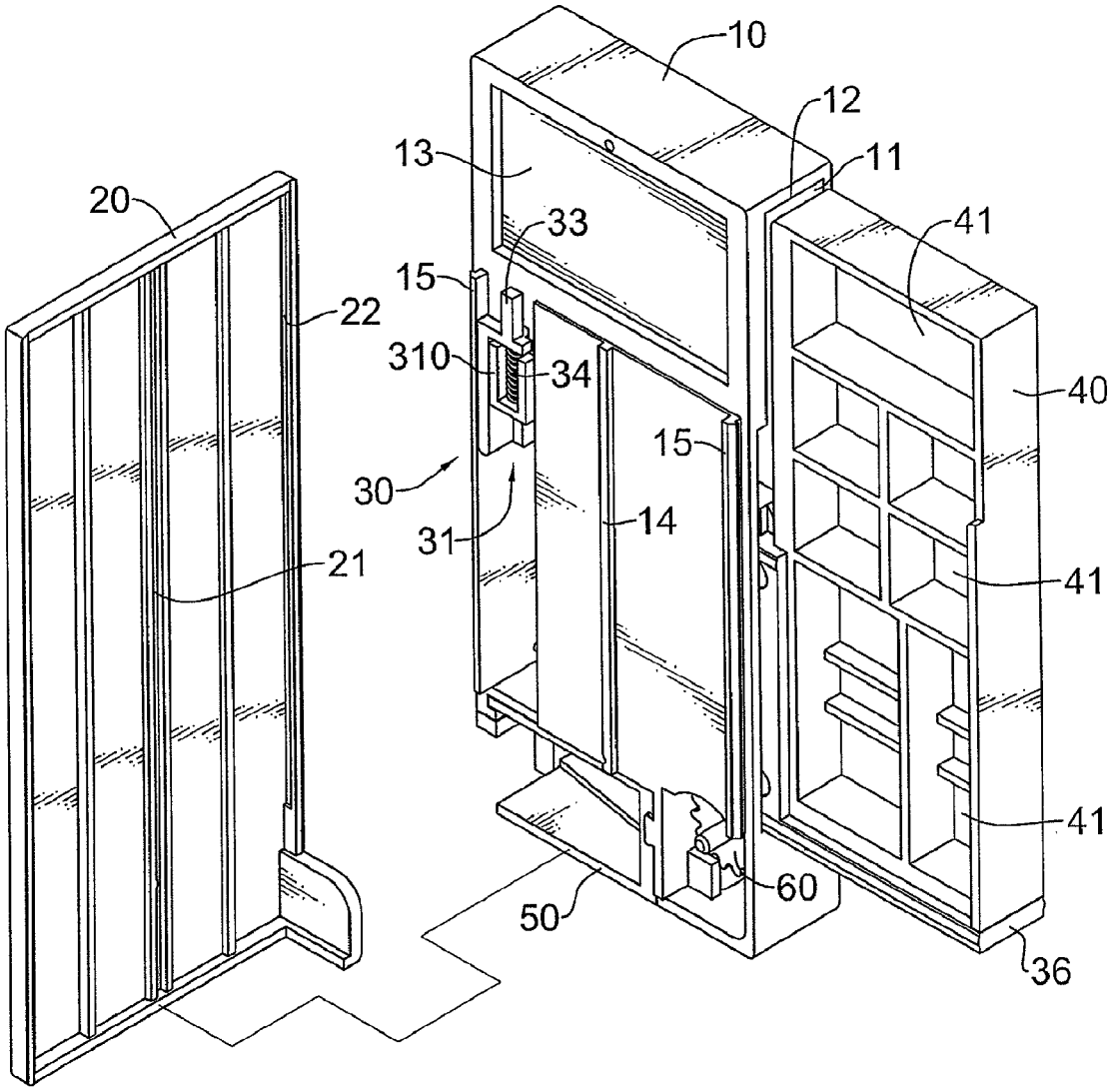
FIG. 3 is a partially exploded perspective view of the cosmetic container in FIG. 2.
Figure 4:
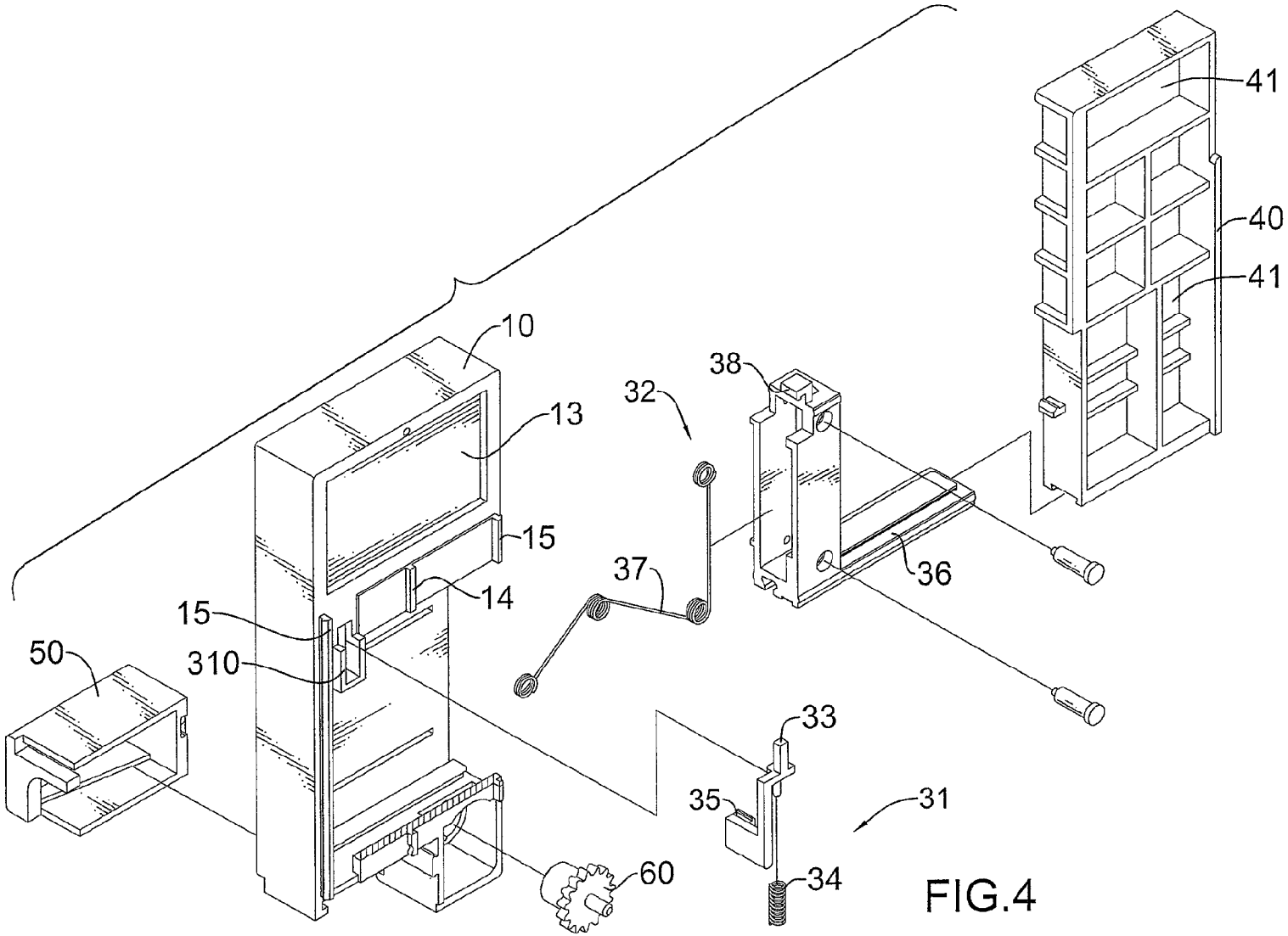
FIG. 4 is an exploded perspective view of the cosmetic container in FIG. 3 without showing the slide cover.

With reference to FIGS. 1 to 4 and 7, a cosmetic container in accordance with the present invention comprises a base (10), a slide cover (20), a drawer (40) and a transmission device (30) and may further have a gear (60).

The base (10) has a front, two opposite sides, a chamber (11), an opening (12), a mirror (13), and may have a sliding rail (14) and two sliding hooks (15). The front has an upper part and a lower part. The chamber (11) is defined in the base (10). The opening (12) is defined in the base (10), may be defined through one side and communicates with the chamber (11). The mirror (13) is mounted on the upper part of the front of the base (10). The sliding rail (14) is longitudinally formed on and protrudes out from the lower part of the front. The sliding hooks (15) are formed on and protrude out from the front respectively adjacent to the sides of the base (10).

The slide cover (20) is slidably mounted on the front of the base (10) and has a top and may have a rear, a rail slot (21) and two hook slots (22). The rear faces the front of the base (10). The rail slot (21) accommodates and engages slidably with the sliding rail (14) so that the slide cover (20) is capable of sliding linearly on the base (10) to cover or reveal the mirror (13). The hook slots (22) respectively accommodate and engage slidably with the sliding hooks (15) so that the slide cover (20) stably slides up and down relative to the base (10) without inadvertently falling from the base (10).

The drawer (40) is used to hold assorted cosmetics, cosmetic tools or both, is slidably mounted in the chamber (11) and selectively extends out of or retracting into the chamber (11) through the opening (12) of the base (10). The drawer (40) may have a front surface, a top surface, multiple compartments (41) and multiple insertion holes (42). In a first embodiment of the cosmetic container, the compartments (41) are defined in the front surface of the drawer (40) and may accommodate different cosmetics like powder, eye shadow, blush or cosmetic tools. In a second embodiment of the cosmetic container, the insertion holes (42) are defined on the top surface of the drawer (40) and are used to hold stick type cosmetics like mascara tube, concealer pencil, eyebrow pencil, lipstick or eye-shadow pencil or cosmetic tools.

Figure 5:
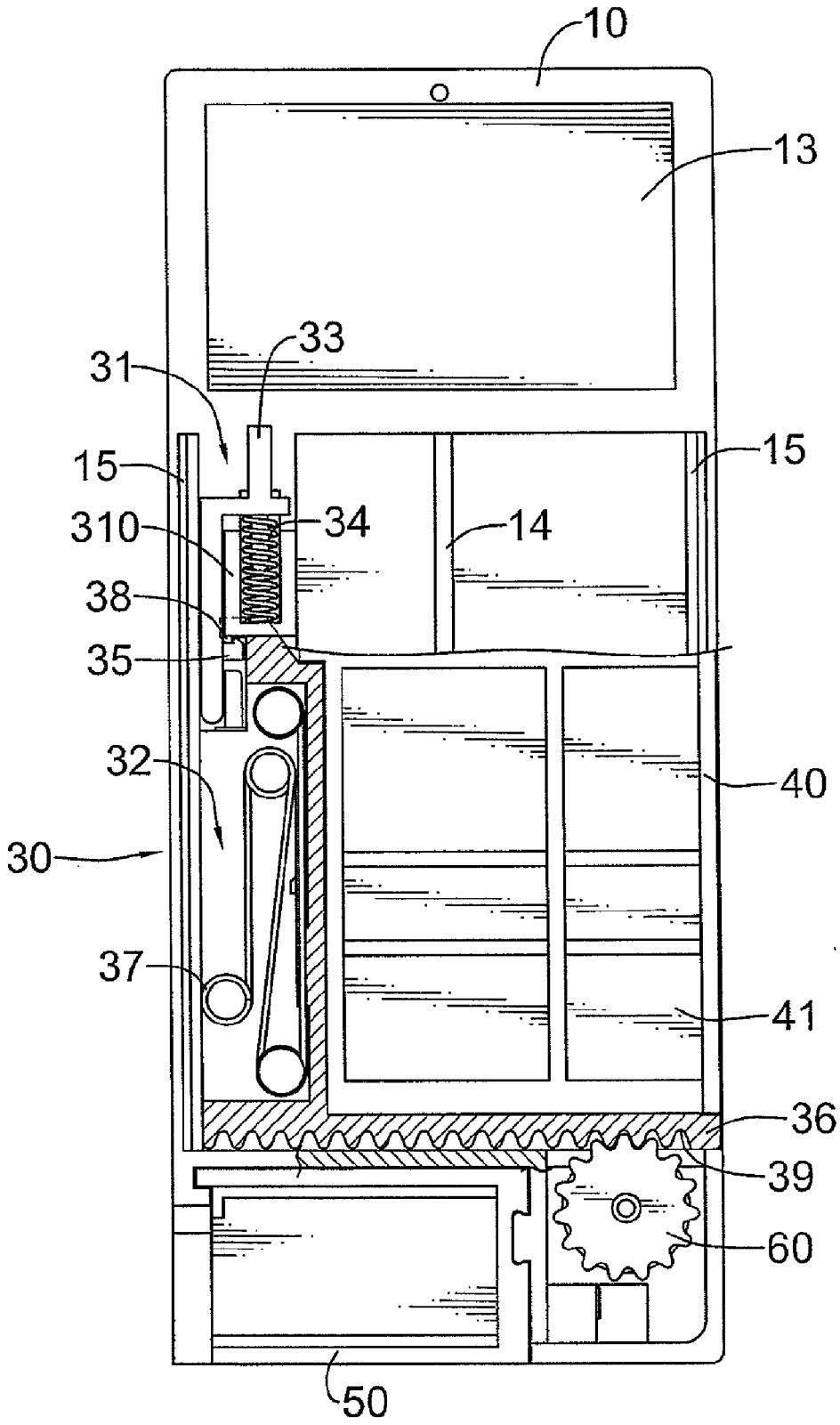
FIG. 5 is a front view in partial section of the cosmetic container in FIG. 1.
Figure 6:
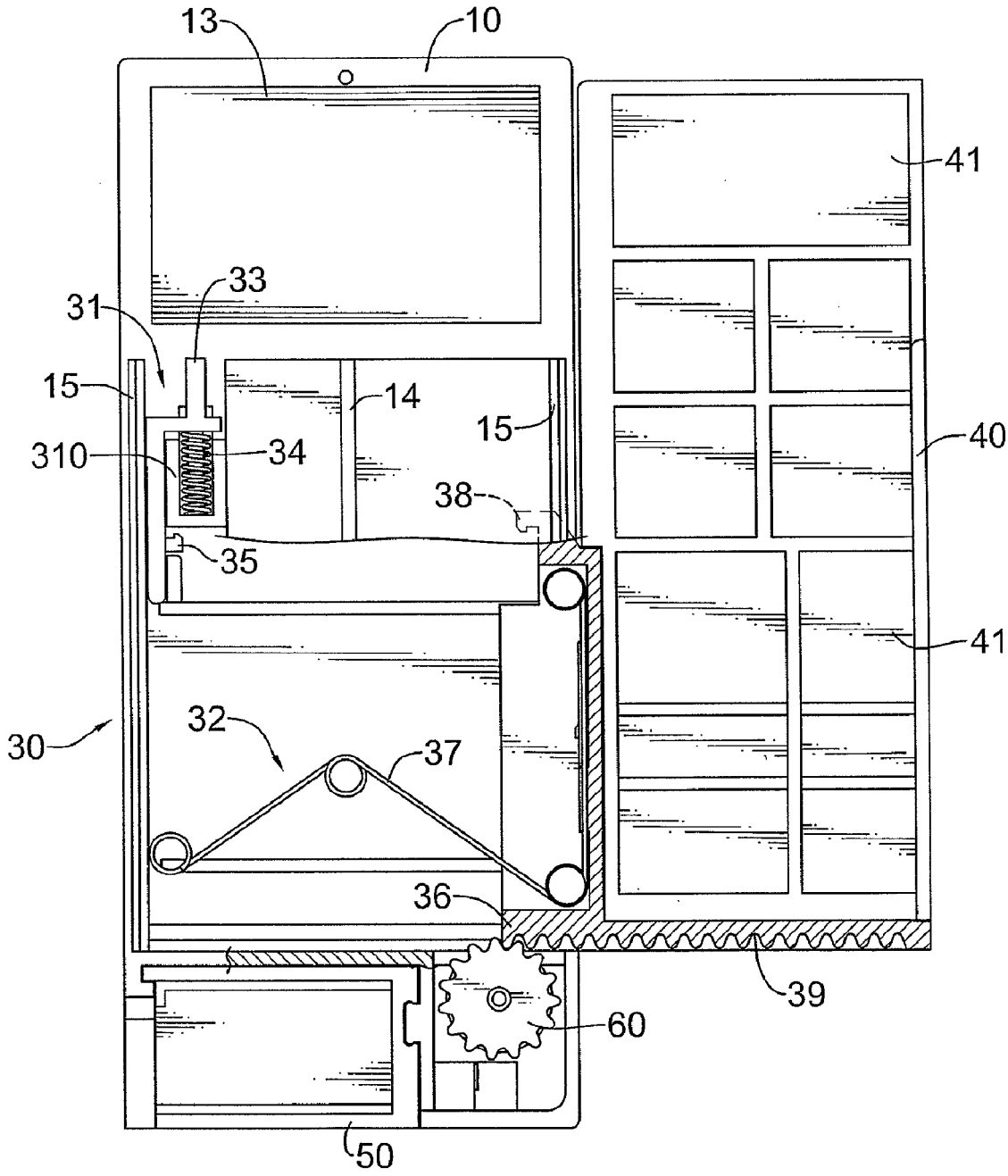
FIG. 6 is an operational front view in partial section of the cosmetic container in FIG. 1 showing the drawer being ejected out from the base by the ejecting assembly.
Figure 7:
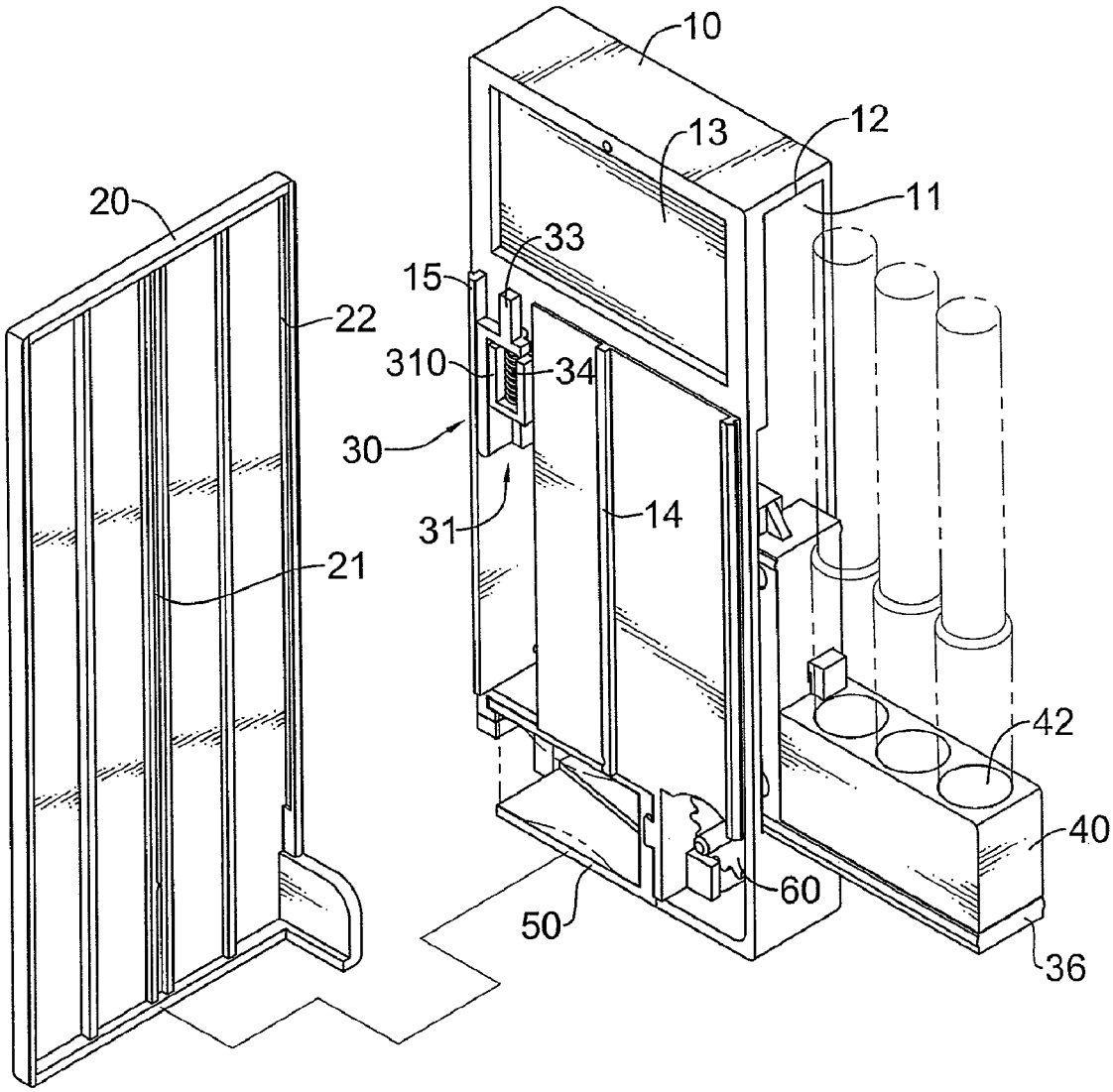
FIG. 7 is a partially exploded perspective view of a second embodiment of a cosmetic container in accordance with the present invention.

With further reference to FIGS. 5 and 6, the transmission device (30) is mounted inside the chamber (11), connects to the slide cover (20) and the drawer (40) and ejects the drawer (40) out of the chamber (11) of the base (10) when driven by the slide cover (20) and may have a locking assembly (31) and an ejecting assembly (32).

The locking assembly (31) may have a spring seat (310) and has a link (33) and a compression spring (34). The spring seat (310) is formed on the front of the base (10) and has a spring slot defined in the spring seat. The link (33) is mounted slidably on the base (10) and protrudes out from the front of the base (10), is selectively pressed and moved by the top of the slide cover (20) and may further have a shaft, an inner sidewall and a hook (35). The shaft protrudes down from the link (33) and is mounted slidably in the spring slot of the spring seat (310). The hook (35) is formed on and protrudes transversely out from the inner sidewall. The compression spring (34) is mounted on the base (10) and biases the link (33) in a locking position to lock and retain the drawer (40) in the chamber (11) and may be mounted in the spring slot around the shaft of the link (33). When the slide cover (20)

slides down relative to the base (10) in a certain distance, the top of the slide cover (20) presses the link (33) downward to a releasing position and compresses the compression spring (34) to unlock and release the drawer (40). When the slide cover (20) is released and slides upward, the compression spring (34) pushes the link (33) back to the locking position.

The ejecting assembly (32) detachably engages with the locking assembly (31) and has a bracket (36) and a torsion spring (37). The bracket (36) selectively extends through the opening (12) of the base (10) and has a top, a drawer mount, a hook (38), and may have a bottom surface and a rack (39). The drawer mount is formed on and protrudes from the bracket (36) and is mounted on and holds the drawer (40). The hook (38) is formed on and transversely protrudes out from the top of the bracket (36) and selectively engages with the hook (35) of the link (33) of the locking assembly (31) so that the drawer (40) is locked by the link (33) through the engagement of the hooks (35, 38). The rack (39) is formed on the bottom surface of the bracket (36) and has multiple teeth. The torsion spring (37) is mounted on the bracket (36), abuts the base (10) and is compressed by the bracket (36) when the drawer (40) retracts inside the chamber (11). When the hooks (35, 38) of the link (33) and the bracket (36) detaches from each other, the torsion spring (37) pushes the bracket (36) and the drawer (40) out of the base (11). The drawer (40) on the drawer mount thus passes out from the base (10).

The cosmetic container may further comprise a cosmetic pencil sharpener (50). The cosmetic pencil sharpener (50) is detachably mounted in the base (10). A user may quickly find the cosmetic pencil sharpener (50) integrated into the conspicuous cosmetic container without blindly searching the cosmetic bag.

The gear (60) is mounted rotatably inside the chamber (11) and engages with the rack (39) of the bracket (36) to stabilize the movement of the bracket (36) and the drawer (40) when moving out of or retracting into the chamber (11) of the base (10). The gear has multiple teeth engaging with those on the rack (39).

When using cosmetics of the cosmetic container, a user pushes and opens the slide cover (20) to expose the mirror (13) of the base (10) to look at the user's face. When the slide cover (20) is pushed and opened, the link (33) of the locking assembly (31) is pressed by the slide cover (20) and detaches the hook (35) of the link (33) from the hook (38) of the bracket (36). The compressed torsion spring (37) then pushes the bracket (36) with the drawer (40) out through the opening (12) of the base (10). Therefore, the drawer (40) is ejected and allows the user to use the cosmetics and tools on the drawer (40). When closing the cosmetic container, the user can push the drawer (40) into the chamber (11) of the base (10) to make the hooks (35, 38) engage with each other and push backward and close the slide cover (20) back.

The cosmetic container with the slide cover (20), transmission device (30) and drawer (40) allows the user to quickly reveal the mirror (13) and eject the drawer (40) simultaneously by merely and simply sliding the slide cover (20). Therefore, operating the cosmetic container is convenient and efficient, which saves the user's time.

Furthermore, the cosmetic container integrated with the mirror (13) and drawer (40) simplifies the carry of different cosmetic products/tools and prevents the user from blindly searching scattered cosmetics products/tools disorderly in the cosmetic bag, which also saves the user's time.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A cosmetic container comprising:

a base having a front having an upper part and a lower part;

two opposite sides;

a chamber being defined in the base;

an opening being formed in the base and communicating with the chamber;

a mirror being mounted on the upper part of the front;

a sliding rail being longitudinally formed on and protruding out from the lower part of the front of the base; and two sliding hooks being formed on and protruding out from the front respectively adjacent to the sides of the base;

a slide cover being slidably mounted on the front of the base, having a top and having a rear facing the front of the base;

a rail slot accommodating and engaging slidably with the sliding rail of the base; and two hook slots respectively accommodating and engaging slidably with the sliding hooks;

a drawer being slidably mounted in the chamber of the base and selectively extending out of or retracting into the chamber through the opening of the base; and a transmission device being mounted inside the chamber, connecting to the slide cover and the drawer and ejecting the drawer out of the chamber of base when driven by the slide cover.

2. The cosmetic container as claimed in claim 1, wherein the transmission device further has:

a locking assembly having a link mounted slidably on the base, selectively pressed and moved by the top of the slide cover and having an inner sidewall; and a hook being formed on and protruding transversely out from the inner sidewall; and a compression spring being mounted on the base and biasing the link in a locking position to lock and retain the drawer in the chamber; and an ejecting assembly detachably engaging with the locking assembly and having a bracket being selectively extending through the opening of the base and having a top;

a drawer mount being formed on the bracket and holding the drawer; and a hook being formed on and transversely protruding out from the top of the bracket and selectively engaging with the hook of the link of the locking assembly; and a torsion spring being mounted on the bracket, abutting the base and being compressed by the bracket when the drawer retracting inside the chamber.

3. The cosmetic container as claimed in claim 2, wherein the drawer further has a front surface; and multiple compartments being defined in the front surface.

4. The cosmetic container as claimed in claim 2, wherein the drawer further has a top surface; and multiple insertion holes being defined on the top surface.

5. The cosmetic container as claimed in claim 2, wherein:
the bracket of the ejecting assembly further has
a bottom surface; and
a rack formed on the bottom surface of the bracket; and
the cosmetic container further has a gear being mounted rotatably inside the chamber and engaging with the rack of the bracket.

6. The cosmetic container as claimed in claim 3, wherein:
the bracket of the ejecting assembly further has
a bottom surface; and
a rack being formed on the bottom surface of the bracket; and
the cosmetic container further has a gear being mounted rotatably inside the chamber and engaging with the rack of the bracket.

7. The cosmetic container as claimed in claim 4, wherein:
the bracket of the ejecting assembly further has
a bottom surface; and
a rack formed on the bottom surface of the bracket; and
the cosmetic container further has a gear being mounted rotatably inside the chamber and engaging with the rack of the bracket.

8. The cosmetic container as claimed in claim 1 further comprising a cosmetic pencil sharpener being detachably mounted in the base.

9. The cosmetic container as claimed in claim 2 further comprising a cosmetic pencil sharpener being detachably mounted in the base.

10. The cosmetic container as claimed in claim 3 further comprising a cosmetic pencil sharpener being detachably mounted in the base.

11. The cosmetic container as claimed in claim 4 further comprising a cosmetic pencil sharpener being detachably mounted in the base.

12. The cosmetic container as claimed in claim 5 further comprising a cosmetic pencil sharpener being detachably mounted in the base.

13. The cosmetic container as claimed in claim 2, wherein:
the locking assembly of the transmission device further has
a spring seat formed on the front of the base and having a spring slot defined in the spring seat;
the link of the locking assembly further has a shaft protruding down from the link and being mounted slidably in the spring slot of the spring seat; and
the compression spring of the locking assembly is mounted in the spring slot around the shaft of the link.

14. A cosmetic container comprising:
a base having
a front having an upper part;
two opposite sides;
a chamber being defined in the base;
an opening being formed in the base and communicating with the chamber; and
a mirror being mounted on the upper part of the front;
a slide cover being slidably mounted on the front of the base and having a top;
a drawer being slidably mounted in the chamber of the base and selectively extending out of or retracting into the chamber through the opening of the base; and
a transmission device being mounted inside the chamber, connecting to the slide cover and the drawer and ejecting the drawer out of the chamber of base when driven by the slide cover,
wherein the transmission device further has:
a locking assembly having
a link mounted slidably on the base, selectively pressed and moved by the top of the slide cover and having an inner sidewall; and
a hook being formed on and protruding transversely out from the inner sidewall; and
a compression spring being mounted on the base and biasing the link in a locking position to lock and retain the drawer in the chamber; and
an ejecting assembly detachably engaging with the locking assembly and having
a bracket being selectively extending through the opening of the base and having
a top;
a drawer mount being formed on the bracket and holding the drawer; and
a hook being formed on and transversely protruding out from the top of the bracket and selectively engaging with the hook of the link of the locking assembly; and
a torsion spring being mounted on the bracket, abutting the base and being compressed by the bracket when the drawer retracting inside the chamber.

15. The cosmetic container as claimed in claim 14, wherein the drawer further has
a front surface; and
multiple compartments being defined in the front surface.

16. The cosmetic container as claimed in claim 14, wherein the drawer further has
a top surface; and
multiple insertion holes being defined on the top surface.

17. The cosmetic container as claimed in claim 14, wherein:
the bracket of the ejecting assembly further has
a bottom surface; and
a rack formed on the bottom surface of the bracket; and
the cosmetic container further has a gear being mounted rotatably inside the chamber and engaging with the rack of the bracket.

18. The cosmetic container as claimed in claim 15, wherein:
the bracket of the ejecting assembly further has
a bottom surface; and
a rack being formed on the bottom surface of the bracket; and
the cosmetic container further has a gear being mounted rotatably inside the chamber and engaging with the rack of the bracket.

19. The cosmetic container as claimed in claim 16, wherein:
the bracket of the ejecting assembly further has
a bottom surface; and
a rack formed on the bottom surface of the bracket; and
the cosmetic container further has a gear being mounted rotatably inside the chamber and engaging with the rack of the bracket.

* * * * *